United States Patent [19]

La Rosa

[11] 3,943,662

[45] Mar. 16, 1976

[54] CASEMENT WINDOW CONVERSION UNIT

[76] Inventor: Frank La Rosa, 704 Cora St., Wyandotte, Mich. 48192

[22] Filed: Dec. 26, 1974

[21] Appl. No.: 532,752

[52] U.S. Cl. ..... 49/63; 52/202; 49/71; 160/49

[51] Int. Cl.[2] ..... E05C 7/02

[58] Field of Search ..... 49/62, 63, 71, 413; 98/88 R; 52/37, 202; 160/48, 49, 90, 91

[56] References Cited

UNITED STATES PATENTS

| | | | |
|---|---|---|---|
| 2,602,501 | 7/1952 | Roos | 49/63 |
| 2,859,493 | 11/1958 | Matschke | 52/202 |
| 3,388,500 | 6/1968 | MacDonald | 49/413 X |

FOREIGN PATENTS OR APPLICATIONS

| | | | |
|---|---|---|---|
| 2,129,407 | 12/1972 | Germany | 49/71 |

*Primary Examiner*—Kenneth Downey
*Attorney, Agent, or Firm*—Whittemore, Hulbert & Belknap

[57] ABSTRACT

The conversion unit is a simple frame structure applied inwardly of a window opening, such as in a residential basement equipped with metal casement windows. It comprises a pair of like triangular end members or panels bridged across inner upright edges thereof by a light-transmitting portion in which a pair of ornamentally decorated sliding panels are mounted, as in a pair of overlapped grooves in a frame part of the panel portion. The unit is applied with outer vertical edges thereof in abutted engagement with a wall carrying the casement window and with upper margins of the generally triangular open frame structure in upwardly flush engaging abutment with the room ceiling just above the casement window zone. the sliding panels are chosen of a decorative plastic, semi-rigid sheet, preferably somewhat flexible in nature, and also by preference provision is made for a removal of the unit from the casement area for full access to the castment window from its interior.

1 Claim, 4 Drawing Figures

CASEMENT WINDOW CONVERSION UNIT

BACKGROUND OF THE INVENTION

1. Field of the Invention

The invention finds a preferred, although not sole, application in the refurbishment or decoration of basement areas, many occupied as game rooms, bars, or the like in order to afford a pleasant and attractive diffused illumination of the room in question. Other applications of a more general nature are, of course, contemplated.

2. Description of the Prior Art

A search has revealed the following patent disclosures:

| | | |
|---|---|---|
| H. F. Belcher | 642,572 | February 6, 1900 |
| Samuel Ish-Shalom et al | 2,075,065 | March 30, 1937 |
| M. Wolters | 2,484,769 | October 11, 1949 |
| E. Pierson | 2,530,724 | November 21, 1950 |

Although these disclosures hint at individual subfeatures of the invention, none thereof shows or suggests the concept of the ornamental casement window conversion unit of the invention.

SUMMARY OF THE INVENTION

The invention affords an extremely inexpensively constructed and releasably installed conversion unit to much improve the appearance of the window area of a basement or like room to which it is applied. The ornamental sliding panels transmit a diffused, non-glare type illumination to the room in daytime; and are equally attractive in appearance when room illumination is by internal artificial light.

The unit will, it is believed, be an attractive one for sale through lumber stores, hardwares and the like for home installation, or as a do-it-yourself item for construction and installation by the homeowner.

DESCRIPTION OF A PREFERRED EMBODIMENT

Figure 1:
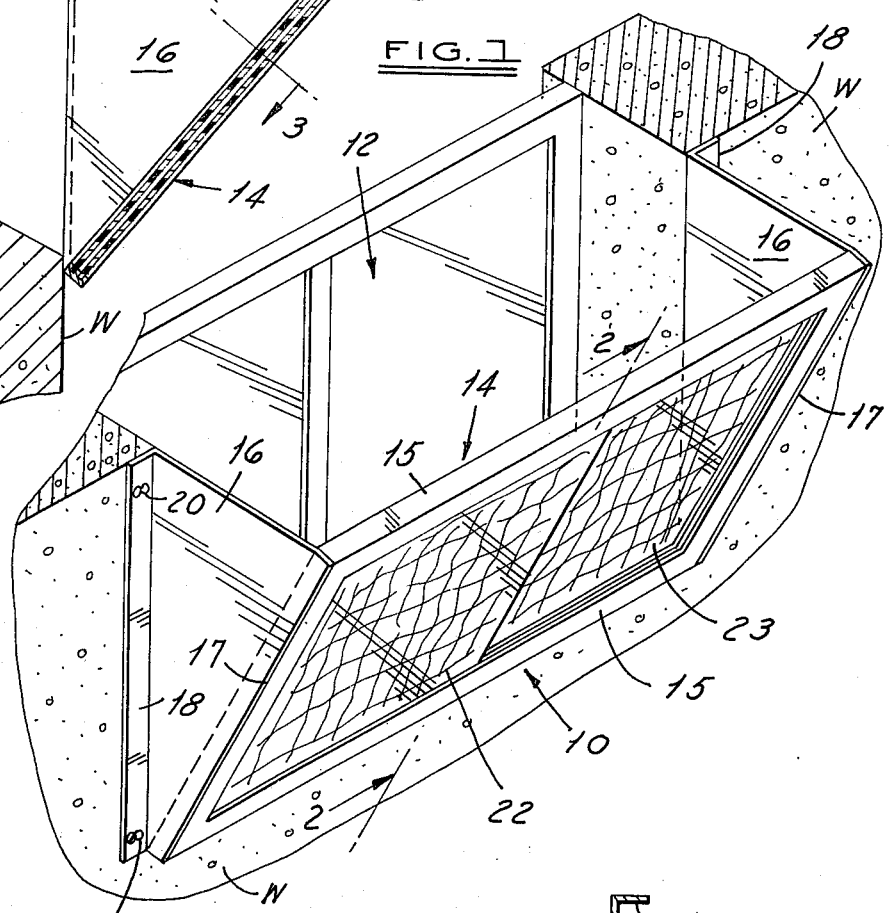
FIG. 1 is a top perspective view of a typical installation of the window conversion unit to a basement room window, also typically of the casement type.

FIG. 1 of the drawing shows a typical installation of the conversion unit of the invention, generally designated by the reference numeral 10, in a residential basement area externally defined by an upright wall W laterally defining a casement offset in which a typical casement window 12 is received, the window being of a conventional type hingedly connected along its top in the space outwardly of wall W. In a such typical installation, the horizontal width of unit 10 will be, say, 38 inches, its height will be 12 inches and its maximum top outer-to-inner dimension will be 10 inches. However, it is contemplated that units 10 will be produced and sold in dimensions suiting them for home installation in casement windows of varying dimensions.

Figure 2:
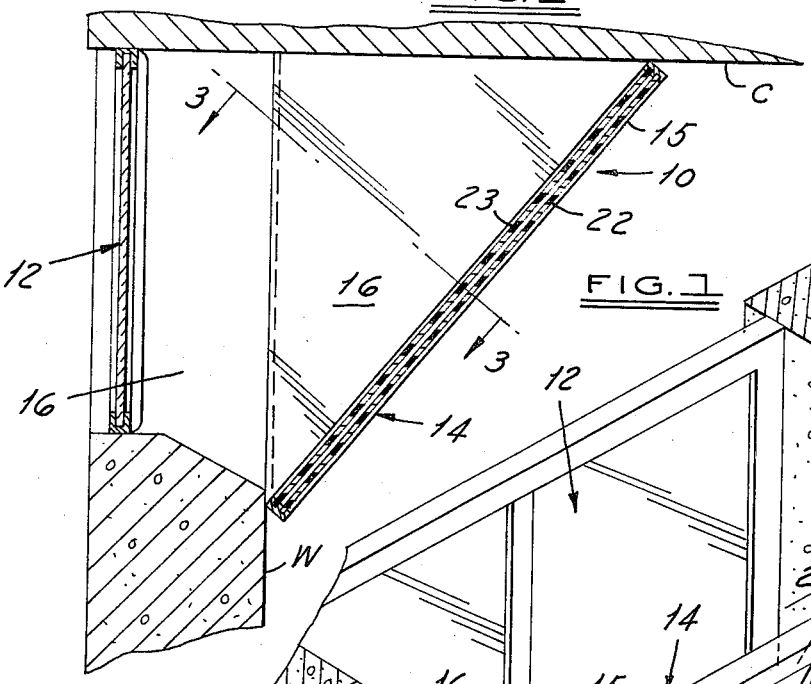
FIG. 2 is a view in transverse vertical section, as on line 2—2 of FIG. 1, showing the relationship of the installed unit to a wall, ceiling and casement space of the room.

Conversion unit 10 is constituted by a very simple frame structure, generally designated 14, which includes an inner rectangular frame portion 15 of the indicated dimension, which as mounted to the wall W diverges inwardly and upwardly (FIG. 2), coming at its top in substantially flush engagement with the ceiling C of the room area. The unit further comprises a pair of identical end panels 16 which are of triangular outline, being fixedly connected at inner upwardly and inwardly divergent edges 17 thereof to end uprights of the rectangular portion 15 of the unit.

Figure 4:
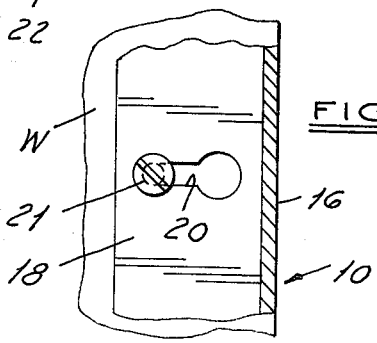
FIG. 4 is a fragmentary view showing a suggested releasable mounting detail for the conversion unit.

End members 16 are shown as being of sheet metal construction, outwardly flanged at their outer limits at 18 for flush abutting engagement with the room wall W; and in the interest of easy and quick full access to the casement window 12 the end members 16 have means for a removable mounting of those members, hence of the unit 10 as a whole, to the wall. Typically, such means are shown specially in FIG. 4 as being in the form of horizontally disposed keyhole-shaped slots 20 slidably engaged over the heads of screws 21 fixedly applied to wall W in vertically spaced relation to one another. See FIG. 1. However, if found desirable, other types of removable mount for unit 10 may be resorted to. As appears in FIGS. 1 and 2, the proportioning of the upwardly divergent frame portion 15 is such that with unit 10 properly mounted the frame's top comes substantially flush with the ceiling C and its bottom similarly comes flush with wall W just beneath the casement space.

Although reference has been made to a stamped sheet metal construction of the end members 16, it is contemplated that they may be of any other appropriate construction, such as plywood, aluminum or plastic. By the same token, the inner frame portion 15 of unit 10 may be formed of wood, aluminum or plastic, in fact any conveniently available material which will enable the formation therein, as by extrusion, routing, etc., of means for slidably accommodating a pair of identical ornamental light diffusing panels 22, 23 of the unit, such provisions being best illustrated in FIGS. 2 and 3.

As therein shown, the frame portion 15 is provided with inner longitudinal slots or grooves 25 along all four of its horizontal and upright reaches for the sliding reception of the innermost panel 22 of the panel pair; and frame structure 15 is similarly grooved at 26 on all four of its upright and horizontal pieces to accommodate the second sliding panel 23 of the unit. Thus, reference being to FIG. 3, inner panel 22 may be manually engaged and slid to its right to an indicated dotted line position for access to the casement window 12 for washing or the like; and the outer panel 23 is correspondingly shiftable to the same end.

As previously indicated, and as appears in FIG. 1, panels 22 are preferably of an ornamental plastic sheeting, translucently light-diffusive and attractively colored in design; and by further preference they are semi-rigid but to some extent flexible to permit a degree of bending thereof sufficient to enable them to be readily removed from and replaced in the slots or grooves 25, 26, in the event a washing of both sides of those panels is in order.

Figure 3:
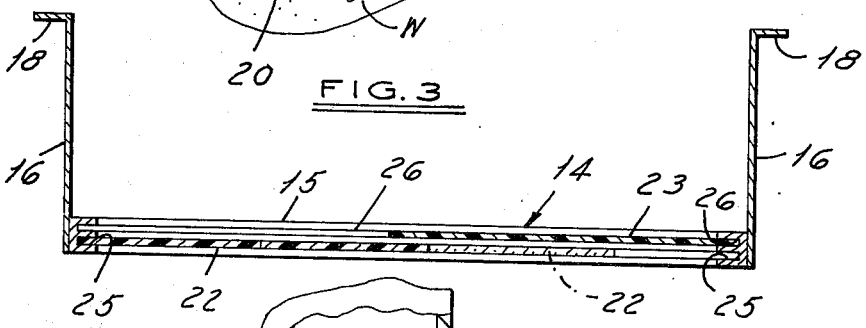
FIG. 3 is a view in generally horizontal transverse section, as on line 3—3 of FIG. 2, slidably adjusted positions of one of the unit's overlapped decorative and diffusive panels being indicated in solid and dotted line.

FIG. 3 shows that in their fully outwardly expanded or spread condition, the ornamental panels 22, 23 have some degree of overlap at adjacent ends thereof for a continuity of appearance of the diffusive panel arrangement as a whole.

What is claimed is:

1. A conversion unit for mounting internally of and over the wall opening of a casement or like room window to ornamentally convert the latter; said unit comprising a frame structure having a pair of like upright end members applicable in outwardly abutting relation at 90° to a wall affording said opening, an inner frame portion connected at its opposite ends to said members in an inwardly and upwardly extending relation to said wall, and at least one panel of light-transmitting material mounted in said inner frame portion to extend in a direction parallel to said wall, said end members of the frame structure being triangular, presenting outer edges in abutting relation to the wall and inner edges divergently angling upwardly toward a room ceiling, to which inner edges the ends of said frame portion are connected, there being at least two light-transmitting panels slidable in said frame portion, said portion having elongated grooves receiving said panels to adjustably slide in an overlapped relationship to one another, said frame structure having means for a ready and manually releasable mounting of the unit to said wall in a predetermined close relationship to said ceiling, the dimensioning of said inner frame portion closely approximating that of said window as said portion parallels said wall, the dimensioning being such that upper and lower members of said frame portion respectively engage with said ceiling and with said wall directly beneath said opening of the latter.

* * * * *